US008472817B2

(12) United States Patent
Konishi et al.

(10) Patent No.: US 8,472,817 B2
(45) Date of Patent: Jun. 25, 2013

(54) IMAGE FORMING APPARATUS

(75) Inventors: Rumi Konishi, Toyonaka (JP); Yoshie Iwakura, Osaka (JP); Yoshinori Shirasaki, Ikeda (JP)

(73) Assignee: Ricoh Company, Limited, Tokyo (JP)

( * ) Notice: Subject to any disclaimer, the term of this patent is extended or adjusted under 35 U.S.C. 154(b) by 202 days.

(21) Appl. No.: 12/843,289

(22) Filed: Jul. 26, 2010

(65) Prior Publication Data

US 2011/0026943 A1 Feb. 3, 2011

(30) Foreign Application Priority Data

Jul. 29, 2009 (JP) ..... 2009-176271

(51) Int. Cl.
*G03G 15/02* (2006.01)
*G03G 15/00* (2006.01)

(52) U.S. Cl.
USPC ..... 399/26; 399/31

(58) Field of Classification Search
USPC ..... 399/9, 26, 31, 34
See application file for complete search history.

(56) References Cited

U.S. PATENT DOCUMENTS 5,809,365 A * 9/1998 Yoshizawa ..... 399/31
6,137,586 A * 10/2000 Kato ..... 358/1.14
7,428,400 B2 9/2008 Iwakura et al.
7,498,578 B2 * 3/2009 Scheuer et al. ..... 250/341.8
7,587,159 B2 9/2009 Fuwa et al.
7,636,539 B2 12/2009 Kawasaki et al.
7,734,235 B2 6/2010 Takehara et al.
8,099,032 B2 1/2012 Iwami et al.
2005/0154562 A1 * 7/2005 Matsuura et al. ..... 702/185
2008/0075476 A1 * 3/2008 Nakazato et al. ..... 399/15
2008/0075480 A1 3/2008 Konishi et al.
2008/0131174 A1 6/2008 Inoue et al.
2008/0152378 A1 6/2008 Yamashita et al.
2008/0199792 A1 8/2008 Kawasaki et al.
2008/0226313 A1 9/2008 Tsuchida et al.
2008/0267641 A1 10/2008 Konishi et al.
2008/0280225 A1 11/2008 Konishi et al.

(Continued)

FOREIGN PATENT DOCUMENTS

JP 7-191580 7/1995
JP 11-161114 6/1999

(Continued)

OTHER PUBLICATIONS

Office Action issued Apr. 17, 2013, in Japan Patent Application No. 2009-176271, filed Jul. 29, 2009.

*Primary Examiner* — David Gray
*Assistant Examiner* — Gregory H Curran
(74) *Attorney, Agent, or Firm* — Oblon, Spivak, McClelland, Maier & Neustadt, L.L.P.

(57) ABSTRACT

An image forming apparatus including at least one latent image carrier, an image forming unit to form a toner image on the at least one latent image carrier based on image data, a transfer body onto which the toner image formed on the at least one latent image carrier is transferred in one or more valid image ranges, a non-image range determiner to determine a non-image range on a surface of the transfer body onto which the toner image is not transferred, a surface detector to detect the surface of the transfer body in the non-image range, and a toner determiner to determine whether or not toner is present in the non-image range based on a result detected by the surface detector.

22 Claims, 7 Drawing Sheets

U.S. PATENT DOCUMENTS

| | | | |
|---|---|---|---|
| 2009/0060540 | A1 | 3/2009 | Matsushita et al. |
| 2009/0180791 | A1 | 7/2009 | Matsushita et al. |
| 2009/0279909 | A1 | 11/2009 | Matsushita et al. |
| 2009/0324270 | A1 | 12/2009 | Yamashita et al. |
| 2010/0098441 | A1 | 4/2010 | Miyazaki et al. |
| 2010/0119273 | A1 | 5/2010 | Komai et al. |

FOREIGN PATENT DOCUMENTS

| | | |
|---|---|---|
| JP | 2004-045903 | 2/2004 |
| JP | 2007-323000 | 12/2007 |
| JP | 2008-275849 | 11/2008 |

* cited by examiner

IMAGE FORMING APPARATUS

CROSS-REFERENCE TO RELATED APPLICATIONS

The present patent application is based on and claims priority pursuant to 35 U.S.C. §119 from Japanese Patent Application No. 2009-176271, filed on Jul. 29, 2009 in the Japan Patent Office, which is incorporated herein by reference in its entirety.

BACKGROUND OF THE INVENTION

1. Field of the Invention

Exemplary aspects of the present invention generally relate to an image forming apparatus such as a copier, a printer, a facsimile machine, and a multifunction device having two or more of copying, printing, and facsimile functions.

2. Description of the Background

Related-art image forming apparatuses, such as copiers, printers, facsimile machines, and multifunction devices having two or more of copying, printing, and facsimile functions, typically form a toner image on a recording medium (e.g., a sheet of paper, etc.) according to image data using an electrophotographic method. In such a method, for example, a charger charges a surface of an image carrier (e.g., a photoconductor); an irradiating device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet; and a fixing device applies heat and pressure to the sheet bearing the toner image to fix the toner image onto the sheet. The sheet bearing the fixed toner image is then discharged from the image forming apparatus.

The image forming apparatuses generally employ either a negative-positive developing system or a positive-positive developing system. While a portion of the surface of the photoconductor exposed to the light beam emitted from the irradiating device is developed in the negative-positive developing system, an unexposed portion of the surface of the photoconductor is developed in the positive-positive developing system. The negative-positive developing system has become common in recent years in digital image forming apparatuses.

In image forming apparatuses employing the negative-positive developing system, an uncharged surface of the photoconductor brought about by a breakdown of the charger or some other malfunction causes an entire portion of the surface of the photoconductor to be developed, resulting in an irregular image throughout which a solid image is formed (hereinafter referred to as a full-page solid image). Similarly, in image forming apparatuses employing the positive-positive developing system, an unexposed surface of the photoconductor caused by a breakdown of the irradiating device or some other malfunction causes an irregular image including the full-page solid image. Continuous image formation in such a state wastes a large amount of both toner and recording sheets. In particular, with facsimile machines, received data is often discarded upon completion of printing of the data for security purposes. Consequently, loss of the facsimile data due to a full-page solid image thus formed causes serious problems because the data cannot be backed up. Therefore, image formation must be immediately stopped upon occurrence of the irregular image including a full-page solid image.

To detect occurrence of a malfunction causing a full-page solid image, one example of a related-art image forming apparatus determines whether or not image data to be written on a surface of a photoconductor includes a full-page solid image. Specifically, occurrence of a malfunction is identified when a density of an image written on the surface of the photoconductor based on the image data indicates that the image includes a full-page solid image even though the image data itself does not include a full-page solid image.

However, because the above-described image forming apparatus identifies the presence of the full-page solid image by calculating the number and size of dots per unit area, extremely precise determination criteria and high accuracy in density detection are required to accurately determine whether the image written on the surface of the photoconductor includes the full-page solid image or merely a high-density image. Further, in a case in which the image forming apparatus includes multiple photoconductors, a density detector must be provided to each of the photoconductors to detect a toner density of each image formed on surfaces of the photoconductors, causing cost increase.

SUMMARY

In view of the foregoing, illustrative embodiments of the present invention provide an improved image forming apparatus that detects irregular images easily and inexpensively.

In one illustrative embodiment, an image forming apparatus including at least one latent image carrier, an image forming unit to form a toner image on the at least one latent image carrier based on image data, a transfer body onto which the toner image formed on the at least one latent image carrier is transferred in one or more valid image ranges, a non-image range determiner to determine a non-image range on a surface of the transfer body onto which the toner image is not transferred, a surface detector to detect the surface of the transfer body in the non-image range, and a toner determiner to determine whether or not toner is present in the non-image range based on a result detected by the surface detector.

Another illustrative embodiment provides a method including the steps of forming a toner image on at least one latent image carrier based on image data, transferring the toner image formed on the at least one latent image carrier onto a transfer body in one or more valid image ranges, determining a non-image range on a surface of the transfer body onto which the toner image is not transferred, detecting the surface of the transfer body in the non-image range, and determining whether or not toner is present in the non-image range based on a result detected in the detecting step.

Additional features and advantages of the present invention will be more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
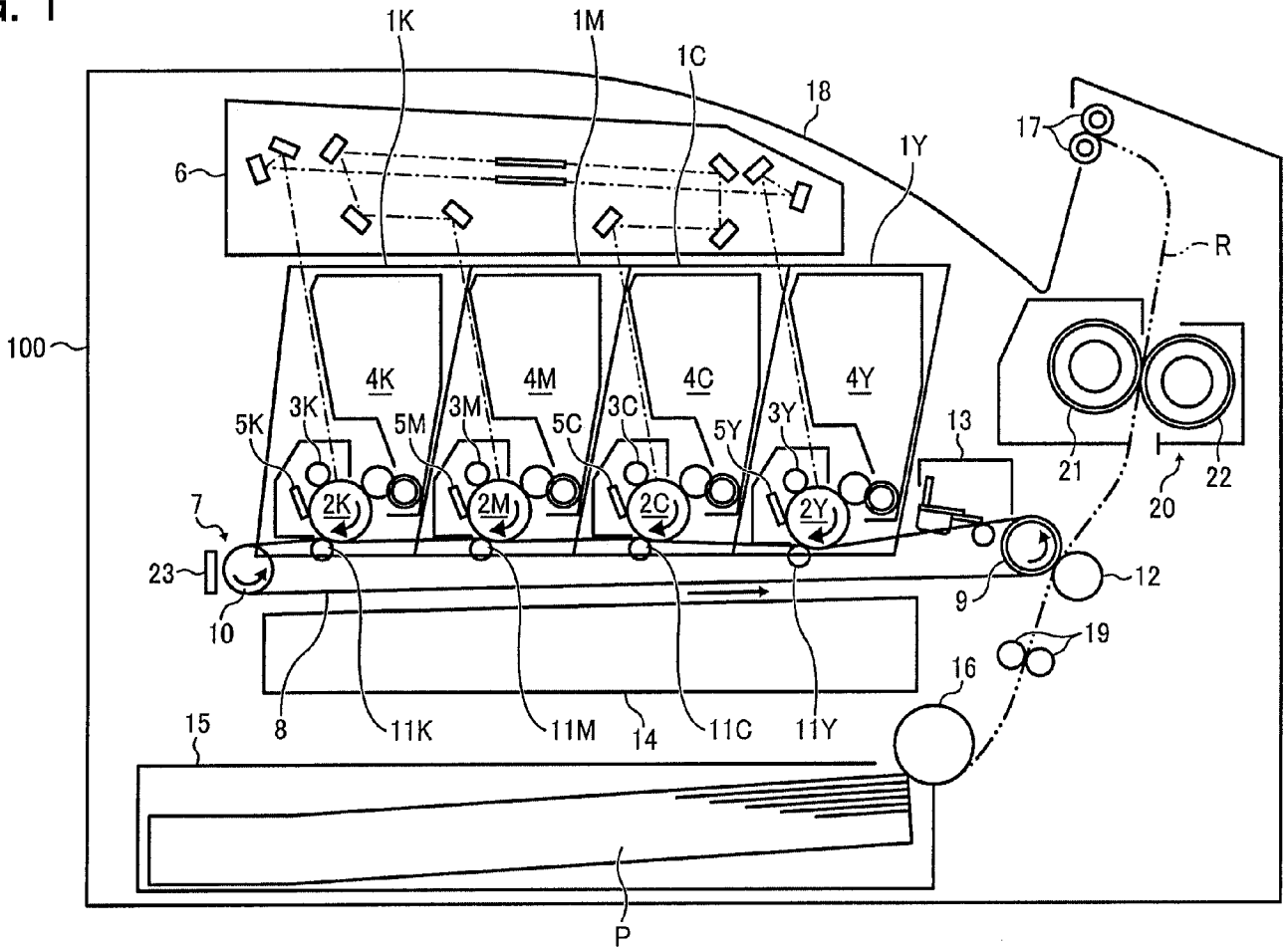
FIG. 1 is a vertical cross-sectional view illustrating an overall configuration of an image forming apparatus according to illustrative embodiments.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings.

In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

A description is now given of a configuration and operations of a full-color image forming apparatus serving as an image forming apparatus 100 according to illustrative embodiments.

FIG. 1 is a vertical cross-sectional view illustrating an overall configuration of the image forming apparatus 100. The image forming apparatus 100 includes four process units 1Y, 1C, 1M, and 1K (hereinafter correctively referred to as process units 1) each detachably attachable to the image forming apparatus 100. Each of the four process units 1 has the same basic configuration, differing only in the color of toner used, that is, yellow, cyan, magenta, or black, each corresponding to color separation components of a full-color image.

The process units 1 include photoconductors 2Y, 2C, 2M, and 2K (hereinafter collectively referred to as photoconductors 2) each serving as a latent image carrier; charging rollers 3Y, 3C, 3M, and 3K (hereinafter collectively referred to as charging rollers 3) each serving as a charger to charge surfaces of the photoconductors 2; developing devices 4Y, 4C, 4M, and 4K (hereinafter collectively referred to as developing devices 4) each supplying toner to the surfaces of the photoconductors 2; and cleaning blades 5Y, 5C, 5M, and 5K (hereinafter collectively referred to as cleaning blades 5) each cleaning the surfaces of the photoconductors 2.

An irradiating device 6 serving as an electrostatic latent image forming unit that directs light onto the surfaces of the photoconductors 2 to form electrostatic latent images on the surfaces of the photoconductors 2 is provided above the process units 1. The irradiating device 6, the charging rollers 3, and the developing device 4 together function as an image forming unit that forms images on the surfaces of the photoconductors 2. A transfer device 7 is provided below the process units 1. The transfer device 7 includes an intermediate transfer belt 8 serving as a transfer body formed of a seamless belt. The intermediate transfer belt 8 is stretched between a drive roller 9 and a driven roller 10 to be rotated in a counterclockwise direction in FIG. 1.

Four primary transfer rollers 11Y, 11C, 11M, and 11K (hereinafter collectively referred to as primary transfer rollers 11) each serving as a primary transfer unit are provided opposite the photoconductors 2 with the intermediate transfer belt 8 therebetween. The primary transfer rollers 11 are pressed against an inner circumferential surface of the intermediate transfer belt 8 to form primary transfer nips between the primary transfer rollers 11 and the photoconductors 2 with the intermediate transfer belt 8 therebetween. A secondary transfer roller 12 serving as a secondary transfer unit is provided opposite the drive roller 9. Specifically, the secondary transfer roller 12 is pressed against the drive roller 9 with the intermediate transfer belt 8 therebetween to form a secondary transfer nip between the secondary transfer roller 12 and the intermediate transfer belt 8.

A belt cleaning device 13 that cleans the intermediate transfer belt 8 is provided on the outer circumferential surface of the intermediate transfer belt 8 on the right in FIG. 1. A waste toner removing hose, not shown, extended from the belt cleaning device 13 is connected to an entrance of a waste toner container 14 provided below the transfer device 7. Density detectors 23 (of which only one is visible in the view shown in FIG. 1) each detecting a density of a toner image formed on the intermediate transfer belt 8 are provided near the outer circumferential surface of the intermediate transfer belt 8 on the left in FIG. 1.

A sheet feed tray 15 that stores recording media such as sheets of paper P, a sheet feed roller 16 that feeds the sheet P from the sheet feed tray 15, and so forth are provided at a bottom portion of the image forming apparatus 100. A pair of discharging rollers 17 that discharges the sheet P from the image forming apparatus 100 and a discharge tray 18 that stacks the sheet P discharged from the image forming apparatus 100 are provided at an upper portion of the image forming apparatus 100.

A conveyance path R, indicated by a broken line and through which the sheet P fed from the sheet feed tray 15 is conveyed to the discharge tray 18, is formed within the image forming apparatus 100. A pair of registration rollers 19 is provided along the conveyance path R between the sheet feed roller 16 and the secondary transfer roller 12. Further, a fixing device 20 that fixes a toner image onto the sheet P is provided along the conveyance path R between the secondary transfer roller 12 and the pair of discharging rollers 17. The fixing device 20 includes a fixing roller 21 serving as a fixing rotary body heated by a heat source, not shown, a pressing roller 22 serving as a pressing rotary body pressed against the fixing roller 21 to form a fixing nip therebetween, and so forth.

A description is now given of basic operations of the image forming apparatus 100 with reference to FIG. 1.

At the start of image formation, the photoconductors 2 in the process units 1 are rotated in a clockwise direction by dedicated drive devices, not shown, respectively, and the surfaces of the photoconductors 2 are evenly charged to a predetermined polarity by the charging rollers 3. Laser light based on image data of a specific color, that is, yellow, cyan, magenta, or black, is directed from the irradiating device 6 onto the charged surfaces of the photoconductors 2 to form electrostatic latent images on the surfaces of the photoconductors 2, respectively. Then, toner of the specified color is supplied from the developing devices 4 to the electrostatic latent images formed on the surfaces of the photoconductors 2 so that toner images of the corresponding color are formed on the surfaces of the photoconductors 2, respectively.

The drive roller 9 is rotatively driven in a counterclockwise direction in FIG. 1 to rotate the intermediate transfer belt 8 in the counterclockwise direction. Further, a voltage under constant current control or constant voltage control and having a polarity opposite a polarity of the toner is applied to each of the primary transfer rollers 11. Accordingly, a transfer electric field is formed at each of the primary transfer nips between the primary transfer rollers 11 and the photoconductors 2 with the intermediate transfer belt 8 interposed therebetween. The toner images formed on the surfaces of the photoconductors 2 are sequentially transferred onto the intermediate transfer belt 8 and superimposed one atop the other by the transfer electric field thus formed at the primary transfer nips. As a result, a full-color toner image is formed on the intermediate transfer belt 8.

Residual toner attached to the surfaces of the photoconductors 2 after the toner images are transferred onto the intermediate transfer belt 8 is removed by the cleaning blades 5. Thereafter, the surfaces of the photoconductors 2 are neutralized by neutralizing devices, not shown, so that potentials on the surfaces of the photoconductors 2 are initialized to be ready for the next image formation sequence.

Meanwhile, the sheet feed roller 16 is rotatively driven to feed the sheet P from the sheet feed tray 15 to the conveyance path R. The sheet P is then conveyed to the secondary transfer nip formed between the secondary transfer roller 12 and the drive roller 9 with the intermediate transfer belt 8 therebetween by the pair of registration rollers 19 at an appropriate timing. At this time, a transfer voltage having a polarity opposite the polarity of the toner of the full-color toner image formed on the intermediate transfer belt 8 is applied to the secondary transfer roller 12 to form a transfer electric field at the secondary transfer nip. The full-color toner image is transferred onto the sheet P from the intermediate transfer belt 8 by the transfer electric field formed at the secondary transfer nip. The sheet P having the full-color toner image thereon is then conveyed to the fixing device 20. In the fixing device 20, heat and pressure are applied to the sheet P by the fixing roller 21 and the pressing roller 22 to fix the full-color toner image onto the sheet P. The sheet P having the fixed full-color toner image thereon is then discharged to the discharge tray 18 by the pair of discharging rollers 17. Residual toner attached to the intermediate transfer belt 8 after the full-color toner image is transferred onto the sheet P is removed by the belt cleaning device 13 and is conveyed to be collected by the waste toner container 14.

The above-described image formation is performed to form a full-color image on the sheet P. Alternatively, one of the process units 1 may be used to form a single-color image, or two or three of the process units 1 may be used to form two- or three-colored images.

The image forming apparatus 100 is designed to perform process control to achieve appropriate image density. At the start of process control, toner patterns or graduation patterns for detecting an image density are formed on the surfaces of the photoconductors 2, respectively, and the toner patterns thus formed are sequentially transferred onto the intermediate transfer belt 8 in the same manner as the image formation process described above. The toner patterns transferred onto the intermediate transfer belt 8 are conveyed to the density detectors 23 by rotation of the intermediate transfer belt 8, and a toner density thereof is detected by the density detectors 23.

Thereafter, image forming conditions are adjusted such that the toner density detected by the density detectors 23 is changed to a target value. For example, charging biases applied by the charging rollers 3, developing biases applied by the developing devices 4, and an amount of light emitted from the irradiating device 6 are controlled to adjust the toner density. Specifically, the developing biases are controlled to adjust a thickness of a toner layer of the toner image, and the charging biases or the amount of light emitted from the irradiating device 6 is controlled to adjust a size of dots in the toner image, that is, graduation reproducibility. As a result, the toner image transferred onto the sheet P has an appropriate image density, achieving a higher-quality image.

Figure 2:
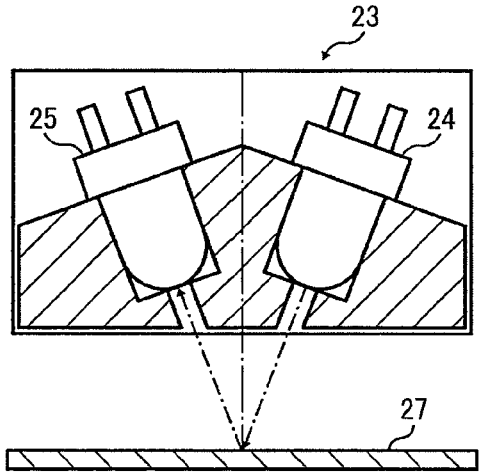
FIG. 2 is a schematic view illustrating a configuration of a density detector included in the image forming apparatus illustrated in FIG. 1.

FIG. 2 is a schematic view illustrating a configuration of the density detectors 23 included in the image forming apparatus 100. In the present embodiment, each of the density detectors 23 is a reflective optical sensor having a light emitting element 24 and a light receiving element 25. It is to be noted that the density detectors 23 are not limited to the reflective optical sensor type. The light emitting element 24 directs light onto a surface to be detected (hereinafter referred to as a detection surface 27), and the light receiving element 25 detects regular reflection light reflected from the detection surface 27. The light emitting element 24 may be an LED or the like, and the light receiving element 25 may be a phototransistor, a photodiode, or the like.

Because the surface of the intermediate transfer belt 8 has sufficiently higher smoothness and glossiness compared to the toner layer of the toner image formed thereon, light emitted from the light emitting element 24 onto the surface of the intermediate transfer belt 8 is substantially reflected regularly from the surface of the intermediate transfer belt 8. By contrast, light emitted from the light emitting element 24 onto the toner layer is absorbed or diffused, and is rarely reflected regularly from the toner layer. Such differences in characteristics between the light emitted to the surface of the intermediate transfer belt 8 and the light emitted to the toner layer are used to calculate a ratio (Vsp/Vsg) of a reflection light detection voltage Vsp of the toner layer to a reflection light detection voltage Vsg on the surface of the intermediate transfer belt 8. The ratio (Vsp/Vsg) is then converted into a toner density using a calculation table or a function prestored in the image forming apparatus 100.

Although the same amount of light continues to be emitted from the light emitting element 24 of the density detectors 23 to the surface of the intermediate transfer belt 8, over time the reflection light detection voltage Vsg on the surface of the intermediate transfer belt 8 changes due to a change in the condition of the surface of the intermediate transfer belt 8 caused by deterioration of the intermediate transfer belt 8 over time. Therefore, it is preferable that the amount of light emitted from the light emitting element 24 be corrected, or calibrated, to compensate for the condition of the intermediate transfer belt 8 before detecting the toner density of the toner image such that the reflection light detection voltage Vsg on the surface of the intermediate transfer belt 8 detected by the density detectors 23 is equal to a predetermined value.

An example of a method for correcting, or calibrating, the amount of light emitted from the light emitting element 24 of the density detectors 23 is described below.

First, an amount of light L emitted from the light emitting element 24 is set to an amount of light $L_1$. Then, light having the amount of light $L_1$ is emitted from the light emitting element 24 to the surface of the intermediate transfer belt 8 to measure a reflection light detection voltage $Vsg_1$ on the surface of the intermediate transfer belt 8. Next, the amount of light L emitted from the light emitting element 24 is changed to an amount of light $L_2$. Then, light having the amount of light $L_2$ is emitted from the light emitting element 24 to the surface of the intermediate transfer belt 8 to measure a reflection light detection voltage $Vsg_2$ on the surface of the intermediate transfer belt 8. The above-described measurement is repeatedly performed at predetermined times using a different amount of light L each time to measure a corresponding reflection light detection voltage Vsg on the surface of the intermediate transfer belt 8. A relational expression or an approximating curve indicating a relativity between the amount of light L emitted from the light emitting element 24 and the reflection light detection voltage Vsg on the surface of the intermediate transfer belt 8 is calculated by a least-squares method based on data obtained by the above-described measurement. The amount of light L emitted from the light emitting element 24 is corrected using the relational expression thus calculated such that the reflection light detection voltage Vsg is equal to a preset specified voltage Vcal.

Once properly calibrated, the density detectors 23 use the presence of toner on parts of the intermediate transfer belt 8 where the toner should not normally occur to identify the occurrence of a malfunction. This process is department below.

In each sequence of image formation described previously, an image for one page is formed on the surfaces of the photoconductors 2 based on image data. A range where the image for one page is formed is determined by transmission of a preset image range signal. Specifically, a frame gate signal that specifies a valid image range on each of the surfaces of the photoconductors 2 in a sub-scanning direction, that is, a direction of conveyance of the image, and a line gate signal that specifies a valid image range on each of the surfaces of the photoconductors 2 in a main scanning direction perpendicular to the sub-scanning direction are set in advance. While those signals are transmitted, an electrostatic latent image is formed on each of the surfaces of the photoconductors 2 based on image data. No electrostatic latent image is formed on the surfaces of the photoconductors 2 while the signals are not transmitted.

Figure 3:
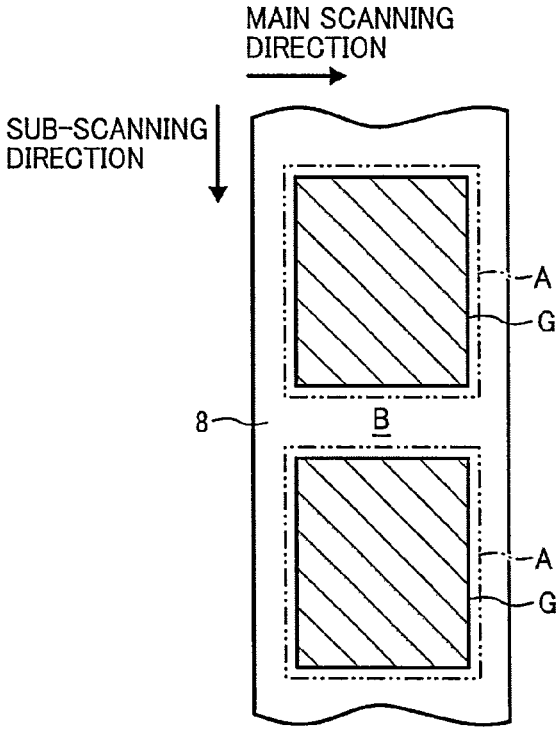
FIG. 3 is a plan view illustrating a non-image range on an intermediate transfer belt included in the image forming apparatus illustrated in FIG. 1.
Figure 8:
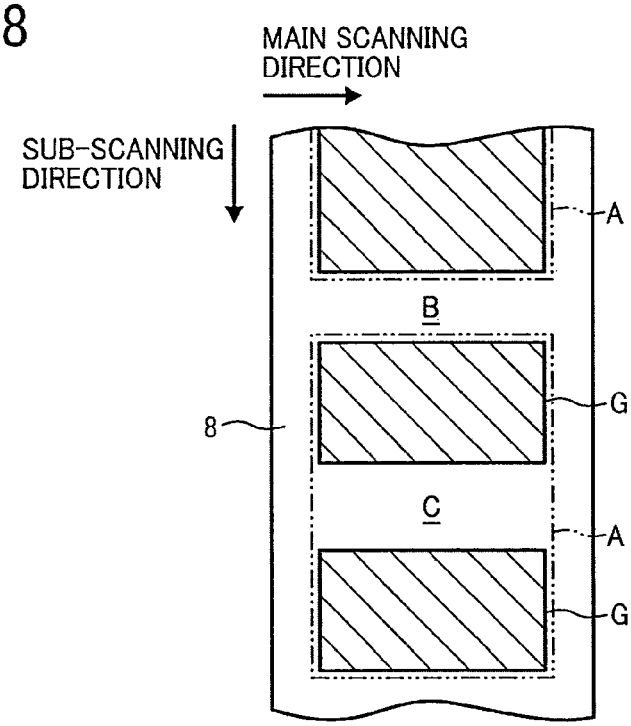
FIG. 8 is a view illustrating a non-image range within a valid image range on the intermediate transfer belt.

FIG. 3 is a plan view illustrating a part of the intermediate transfer belt 8. A range A in FIG. 3 indicates a valid image range on the intermediate transfer belt 8 onto which a toner image G for one page formed on the surfaces of the photoconductors 2 based on image data is transferred (hereinafter also referred to as a valid image range A). In other words, the valid image range A on the intermediate transfer belt 8 corresponds to the valid image range on the surfaces of the photoconductors 2 determined by the signals described above. By contrast, no toner image is transferred onto a range B positioned between the valid image ranges A as long as image formation is normally performed. It is to be noted that, as shown in FIG. 8 and to be described in detail later, a range C having a certain size onto which the toner image G is not transferred may exist within the valid image range A depending on the toner images formed on the surfaces of the photoconductors 2. A portion on the surface of the intermediate transfer belt 8 such as the ranges B and C onto which the toner image G is not transferred is hereinafter referred to as a non-image range such as non-image ranges B and C.

When image formation is performed normally, toner of the toner images formed on the surfaces of the photoconductors 2 is not attached to the non-image ranges B and C on the intermediate transfer belt 8. However, when a malfunction occurs, toner may be attached to the non-image ranges B and C.

Specifically, during normal image formation, the surfaces of the photoconductors 2 are charged to in a range between −500V and −700V regardless of transmission of the frame gate signal, and a developing bias in a range between −100V and −300V is applied to each of developing rollers included in the developing devices 4. When the light is directed onto the charged surfaces of the photoconductors 2 from the irradiating device 6, portions on the charged surfaces of the photoconductors 2 exposed to the light have a potential in a range between −50V and 0V to form electrostatic latent images. Then, negatively charged toner is supplied from the developing rollers to the electrostatic latent images thus formed on the surfaces of the photoconductors 2. Meanwhile, electric fields that move the negatively charged toner from the developing rollers to the surfaces of the photoconductors 2 are not formed at portions on the surfaces of the photoconductors 2 unexposed to the light directed from the irradiating device 6. Accordingly, toner is not attached to such portions on the surfaces of the photoconductors 2.

However, when the surfaces of the photoconductors 2 are not charged normally due to breakdown of the charging rollers 3 or the like, an electric field having a direction opposite that of an electric field formed during normal operation is formed at the unexposed portions on the surfaces of the photoconductors 2. As a result, toner is moved from the developing rollers to the unexposed portions on the surfaces of the photoconductors 2 and is attached to the unexposed portions onto which toner is not attached during normal operation. Such toner is then transferred onto the intermediate transfer belt 8 and shows up in the non-image ranges B and C on the intermediate transfer belt 8.

In the present invention, presence of the toner in the non-image ranges B and C on the surface of the intermediate transfer belt 8 is used to detect the occurrence of a malfunction.

A description is now given of a first illustrative embodiment of the present invention, which makes use of the principles and processes described above.

Figure 4:
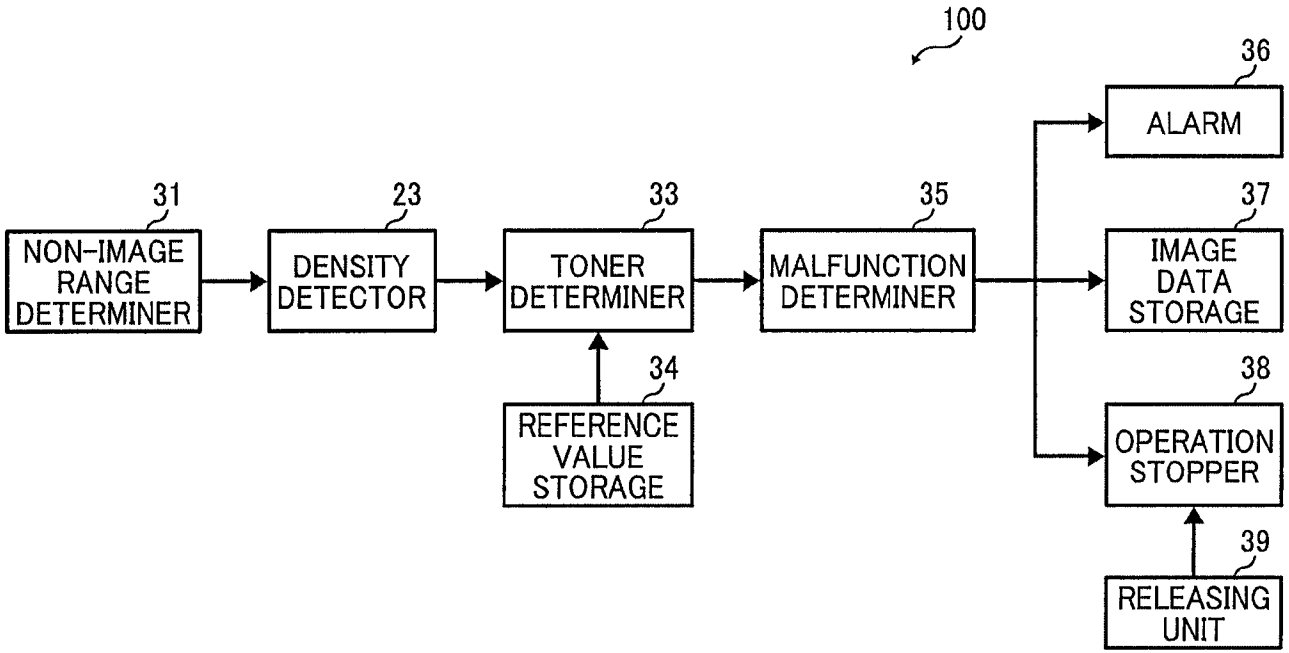
FIG. 4 is a block diagram illustrating a configuration of a control system that detects occurrence of a malfunction in the image forming apparatus illustrated in FIG. 1.

FIG. 4 is a block diagram illustrating a configuration of a control system that detects a malfunction in the image forming apparatus 100. The image forming apparatus 100 includes a non-image range determiner 31, the density detectors 23 each serving as a surface detector, a toner determiner 33, a reference value storage 34, a malfunction determiner 35, an alarm 36, an image data storage 37, an operation stopper 38, and a releasing unit 39.

The non-image range determiner 31 determines a non-image range on the intermediate transfer belt 8. In the first illustrative embodiment, the non-image range determiner 31 determines the non-image range on the intermediate transfer belt 8 based on a timing when transmission of the frame gate signal that specifies the valid image range on the surfaces of the photoconductors 2 in the sub-scanning direction is stopped. As a result, the range B positioned between the valid image ranges A on the intermediate transfer belt 8 is determined as a non-image range. The non-image range is easily determined based on the timing of transmission of the frame gate signal.

Figure 5:
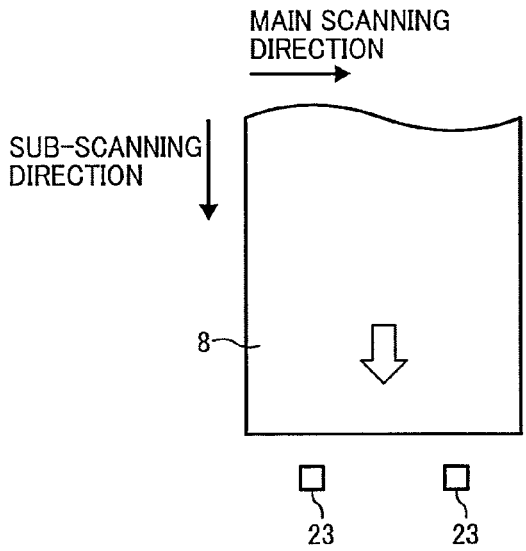
FIG. 5 is a view illustrating relative positions of the density detectors and the intermediate transfer belt.

Each of the density detectors 23 described previously also serves as a surface detector that detects a surface of the non-image range on the intermediate transfer belt 8 in the image forming apparatus 100. In the first illustrative embodiment, the two density detectors 23 are provided near the intermediate transfer belt 8 in a main scanning direction, that is, a width direction of the intermediate transfer belt 8, as illustrated in FIG. 5. Number of the density detectors is not particularly limited to two, and three or more density detectors may be provided on the intermediate transfer belt 8 in the main scanning direction. Alternatively, a single density detector having multiple detection ranges may be provided. Further alternatively, both the number of the density detectors and that of the detection ranges may be one.

The toner determiner 33 identifies the presence of toner in the non-image range on the intermediate transfer belt 8 based on a result detected by the density detectors 23. A prominent difference is found in the toner density detected by the density detectors 23 between when the toner is present in the non-image range and when the toner is not present in the non-image range. Detecting the toner density in a range between 0% and 100%, a toner density of around 0% is detected when the toner is not present in the non-image range on the intermediate transfer belt 8, and a toner density of around 100% is detected when the toner is present in the non-image range on the intermediate transfer belt 8.

Here, a toner density of 50% is set as a reference toner density, that is, a critical threshold level detected by the density detectors 23 that enables the toner determiner 33 to determine whether toner is deemed to be present in the non-image range or not. When the toner density detected by the density detectors 23 exceeds 50%, it is determined that the toner is present in the non-image range on the intermediate transfer belt 8. By contrast, when the toner density detected by the density detectors 23 is lower than 50%, it is determined that the toner is not present in the non-image range on the intermediate transfer belt 8.

Setting of the fixed reference value facilitates determination of presence or absence of the toner in the non-image range on the intermediate transfer belt 8 and reduces image processing load. It is to be noted that the reference value is not particularly limited to 50%, and values between 0% and 100% except the values around 0% and 100% may be set as the reference value. The reference value thus preset is stored in the reference value storage 34.

Figure 6A:
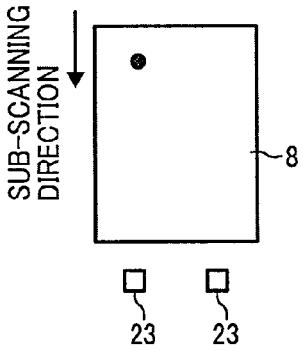
FIGS. 6A to 6C are views respectively illustrating examples of types of malfunction occurring on the intermediate transfer belt in the image forming apparatus illustrated in FIG. 1.
Figure 6B:
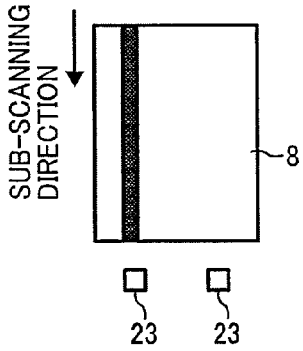
Figure 6C:
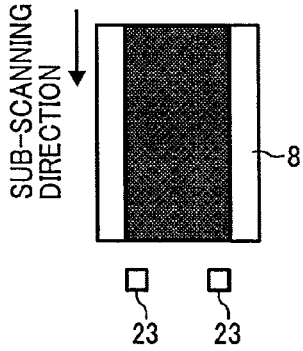

The malfunction determiner 35 determines a type of malfunction based on the number of the density detectors 23 or the detection ranges detecting presence of the toner in the non-image range on the intermediate transfer belt 8. FIGS. 6A to 6C are views respectively illustrating examples of types of malfunction occurring on the intermediate transfer belt 8. Specifically, an example of an irregular toner image formed on the intermediate transfer belt 8 due to weakly-charged toner dropped from the process units 1 is illustrated in FIG. 6A. FIG. 6B illustrates another example of an irregular image including a vertical line formed on the intermediate transfer belt 8 caused by blur on the charging rollers 3. FIG. 6C illustrates yet another example of an irregular image including a full-page solid image formed on the intermediate transfer belt 8 due to irregular charging of the surfaces of the photoconductors 2.

When only one of the two density detectors 23 detects presence of toner (or a toner density that indicates presence of toner) in the non-image range on the intermediate transfer belt 8, it is determined that partial attachment of the toner may cause an irregular image, so that a malfunction such as those illustrated in FIGS. 6A and 6B may occur. By contrast, when both of the two density detectors 23 detect presence of toner in the non-image range on the intermediate transfer belt 8, it is determined that an irregular image including a full-page solid image is formed on the intermediate transfer belt 8 as illustrated in FIG. 6C.

The alarm 36 issues an alert when a malfunction is detected. The alarm 36 may issue a visual or auditory alert by blinking a lamp or outputting an alarm sound or a voice message. Alternatively, blinking of the lamp and output of the alarm sound or the voice message may be combined to issue the alert.

The image data storage 37 stores image data when malfunction is detected. In a case in which occurrence of malfunction is confirmed by detecting presence of toner in the non-image range on the intermediate transfer belt 8, the image data storage 37 stores at least image data of a valid image range (or a predetermined image range) immediately before the non-image range.

The operation stopper 38 automatically stops image formation performed by the image forming apparatus 100 when a malfunction is detected, and image formation is resumed by the releasing unit 39. The releasing unit 39 may be operated through, for example, a touch panel or a switch provided to the image forming apparatus 100.

Figure 7:
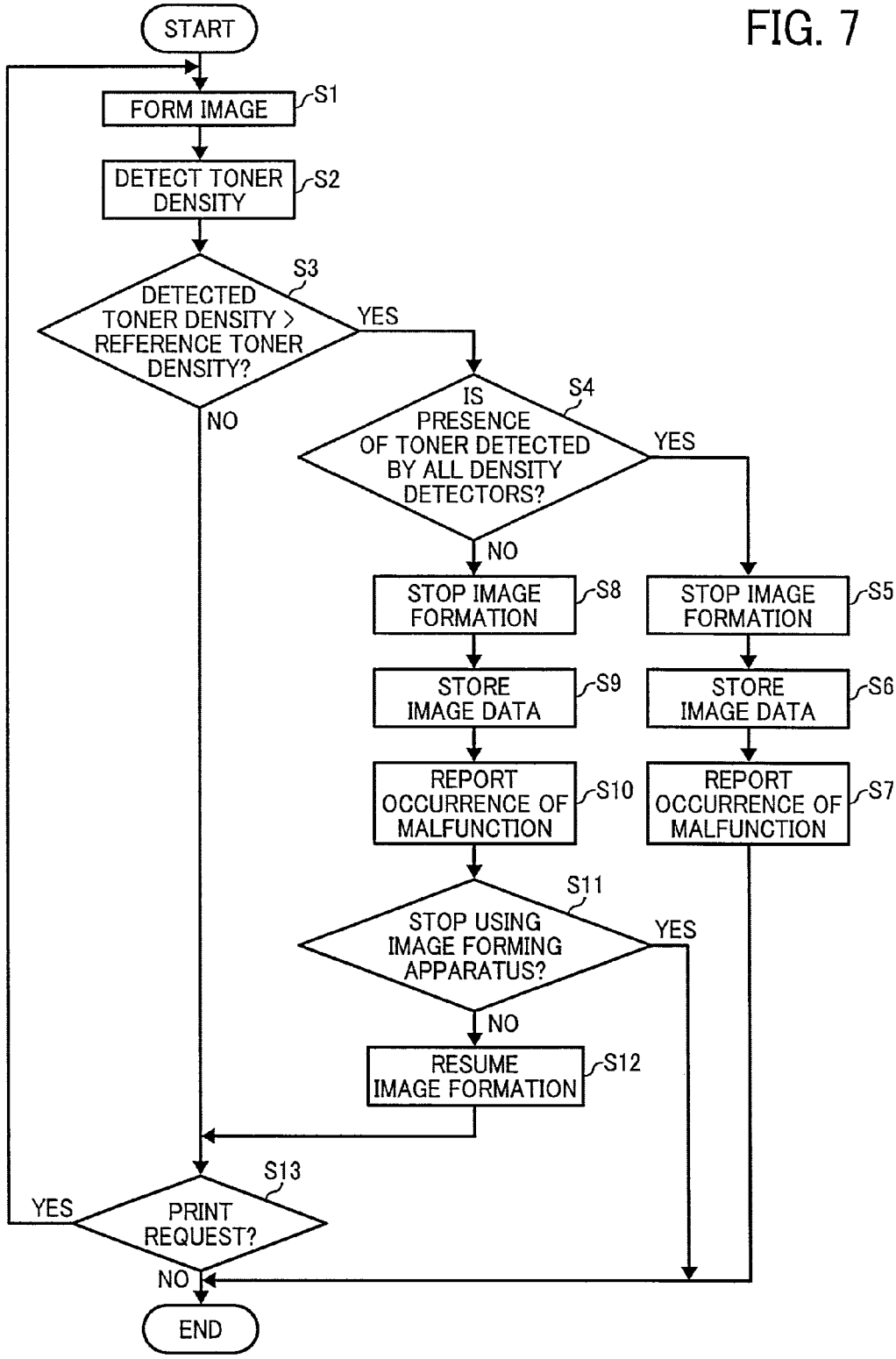
FIG. 7 is a flowchart illustrating steps in a process of detecting occurrence of a malfunction in the image forming apparatus illustrated in FIG. 1.

A description is now given of detection of occurrence of a malfunction performed by the image forming apparatus 100 with reference to FIG. 7. FIG. 7 is a flowchart illustrating steps in a process of detecting occurrence of a malfunction in the image forming apparatus 100.

When image formation is started, at S1 toner images for the first page are formed on the surfaces of the photoconductors 2 based on image data. The toner images thus formed on the surfaces of the photoconductors 2 are sequentially transferred onto the intermediate transfer belt 8 and superimposed one atop the other. The non-image range B on the intermediate transfer belt 8 is determined by the non-image range determiner 31 based on the timing when transmission of the frame gate signal is stopped. Specifically, a range adjacent to a rear edge of the valid image range A onto which the toner images for the first page are transferred is determined as the non-image range B. In the first illustrative embodiment, the non-image range B is determined based on a timing when transmission of a frame gate signal for forming a toner image of black is stopped.

When the non-image range B on the intermediate transfer belt 8 reaches the two density detectors 23, at S2 a surface of the non-image range B is detected by each of the two density detectors 23 to calculate a toner density D. Specifically, a ratio (V/Vsg) of a detection voltage V in the non-image range B detected by the density detectors 23 to the reflection light detection voltage Vsg on the surface of the intermediate transfer belt 8 detected in advance is converted into a toner density using a calculation table or a function to calculate the toner density D. The reflection light detection voltage Vsg on the surface of the intermediate transfer belt 8 is detected in advance during process control in which the image density is appropriately adjusted or during initialization performed when the image forming apparatus 100 is turned on or is returned to a normal operating mode from an energy-saving mode.

Thereafter, at S3, the toner density D in the non-image range B is compared to a reference toner density Dth stored in the reference value storage 34 by the toner determiner 33 to determine presence or absence of the toner. When the toner density D is less than the reference toner density Dth (NO at S3), it is determined that the toner is not present in the non-image range B. In other words, it is determined that no malfunction is found. Thereafter, the process proceeds to S13 to determine whether or not a print request for the second or subsequent page is present. When the print request is present (YES at S13), the process returns to S1 to perform the next image formation sequence.

By contrast, when the toner density D exceeds the reference toner density Dth (YES at S3), it is determined that the toner is present in the non-image range B. At S4, it is confirmed whether or not both of the two density detectors 23 determine that the toner is present in the non-image range B using the malfunction determiner 35 to determine a type of malfunction occurring in the image forming apparatus 100 based on the result thus confirmed. When the presence of the toner in the non-image range B is detected by both of the two density detectors 23 (YES at S4), it is determined that a malfunction causing an irregular image including a full-page solid image as illustrated in FIG. 6C has occurred, and the process proceeds to S5. By contrast, when the presence of the toner in the non-image range B is detected by only one of the two density detectors 23 (NO at S4), it is determined that a malfunction causing an irregular image due to partial attachment of toner as illustrated in FIGS. 6A and 6B has occurred, and the process proceeds to S8.

At S5, image formation is automatically stopped by the operation stopper 38 to prevent formation of irregular images. Image formation is then prohibited until the malfunction is fixed by repair or exchange of the process units 1. In addition, because the malfunction may have occurred in the toner image G, that is, an image for the first page, formed in the valid image range A immediately in front of the non-image range B in which occurrence of the malfunction is detected, at S6 image data of the toner image G in the valid image range A is stored in the image data storage 37 for backup. When subsequent image data, that is, image data for the second and subsequent page, is present, the image data storage 37 also stores such image data. Thereafter, at S7, the alarm 36 issues an alert to report occurrence of the malfunction to a user. It is to be noted that the image data storage 37 stores image data temporarily, and the image data stored in the image data storage 37 is deleted after the malfunction of the image forming apparatus 100 is solved, image formation is resumed, and an image is properly formed based on the image data thus stored.

Processes performed from S8 to S10 are the same as those performed from S5 to S7. Then, at S11, it is confirmed by the user whether or not to stop use of the image forming apparatus 100. Specifically, for example, a soft key is displayed on a touch panel provided to the image forming apparatus 100 so that the user can select whether or not to stop use of the image forming apparatus 100. If the user checks a resultant image for the first page and determines that the irregularity included in the resultant image is acceptable, an instruction for not stopping use of the image forming apparatus 100 is selected by the user through the touch panel or the like (NO at S11). At S12, the releasing unit 39 resumes image formation, and the process proceeds to S13. At S13, it is determined whether or not a print request for the second or subsequent page is present. When the print request is present (YES at S13), the process returns to S1 to perform the next image formation sequence.

It is to be noted that after image formation is resumed by the releasing unit 39 at S12, the image data for the first page temporarily stored in the image data storage 37 is deleted because the image for the first page does not need to be formed again. By contrast, when the user determines to stop use of the image forming apparatus 100 (YES at S11), an instruction for stopping use of the image forming apparatus 100 is input by the user through the touch panel or the like. Accordingly, use of the image forming apparatus 100 is prohibited until the malfunction is fixed by repair or exchange of the process units 1. In addition, when image data for the second and subsequent pages is present, the image data storage 37 stores such image data.

Irregular image detection as described above is similarly performed when images for the second and subsequent pages are formed.

In the first illustrative embodiment, it is assumed that a surface of the intermediate transfer belt 8 onto which toner is not attached is detected to obtain the reflection light detection voltage Vsg on the surface of the intermediate transfer belt 8 detected in advance in order to calculate the toner density D in the non-image range B. However, when a malfunction such as irregular charging of the surfaces of the photoconductors 2 occur while detecting the reflection light detection voltage Vsg on the surface of the intermediate transfer belt 8, toner may be attached to the surface of the intermediate transfer belt 8. For example, if the image forming apparatus 100 further includes a mechanism for separating the intermediate transfer belt 8 from the photoconductors 2, even when the toner is attached throughout the surfaces of the photoconductors 2 due to a malfunction, the intermediate transfer belt 8 is separated from the photoconductors 2 to clean the intermediate transfer belt 8 so that a toner-free surface of the intermediate transfer belt 8 can be provided. However, in the image forming apparatus 100 without such a mechanism for separating the intermediate transfer belt 8 from the photoconductors 2, the intermediate transfer belt 8 constantly contacts the photoconductors 2. Consequently, the toner attached throughout the surfaces of the photoconductors 2 due to a malfunction may be further attached to the intermediate transfer belt 8. As a result, the surface of the intermediate transfer belt 8 without toner may not be achieved.

To provide the surface of the intermediate transfer belt 8 without toner even when a malfunction occurs, the image forming apparatus 100 employs a development control mode. In the development control mode, an electric field for electrostatically moving toner from the surfaces of the photoconductors 2 to the developing rollers is formed. Specifically, during process control in which the surface of the intermediate transfer belt 8 is detected or during initialization, the surfaces of the photoconductors 8 are charged to in a range between −500V and −700V in the same manner as image formation described previously, and a voltage in a range between +50V and +150V and having a polarity opposite the polarity of the voltage applied during image formation is applied to each of the developing rollers. Accordingly, negatively charged toner is attracted to the developing rollers. Therefore, even when the surfaces of the photoconductors 2 are irregularly charged, attachment of the toner to the surfaces of the photoconductors 2 from the developing rollers and attachment of the toner to the intermediate transfer belt 8 from the surfaces of the photoconductors 2 can be prevented. As a result, the development control mode can provide a toner-free surface of the intermediate transfer belt 8 even when a malfunction occurs, and the reflection light detection voltage Vsg on the surface of the intermediate transfer belt 8 can be reliably obtained by detecting the toner-free surface of the intermediate transfer belt 8.

A description is now given of a second illustrative embodiment of the present invention. In the first illustrative embodiment, only the range B between the valid image ranges A is determined as a non-image range. By contrast, in the second illustrative embodiment, the range C within the valid image range A onto which the toner image G is not transferred is also determined as a non-image range as illustrated in FIG. 8. Accordingly, occurrence of a malfunction is detected earlier than in the first illustrative embodiment in which presence or absence of toner is detected only at the non-image range B positioned between the valid image ranges A. The non-image range C within the valid image range A is also determined by the non-image range determiner 31.

Figure 9A:
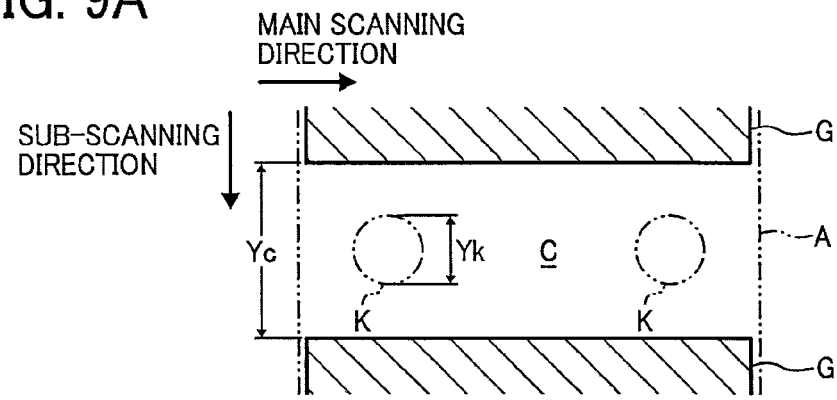
FIGS. 9A and 9B are views respectively illustrating examples of a relation between size of a non-image range and size of a detection range.
Figure 9B:
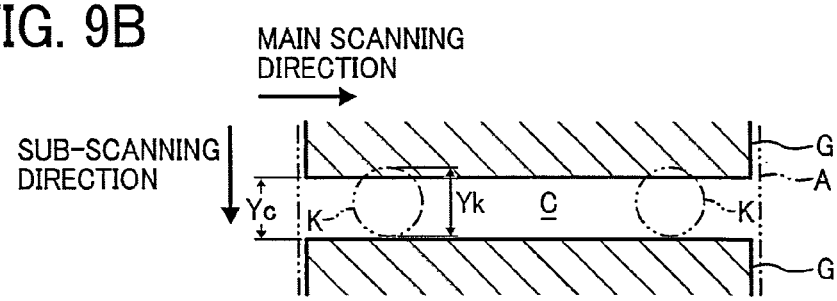

The non-image range C is determined as follows. When a length Yc of the range C in the sub-scanning direction is equal to or longer than a length Yk of a detection range K of the density detectors 23 in the sub-scanning direction as illustrated in FIG. 9A, the range C is determined as a non-image range. By contrast, when the length Yc of the range C in the sub-scanning direction is shorter than the length Yk of the detection range K of the density detectors 23 in the sub-scanning direction as illustrated in FIG. 9B, the toner image G adjacent to the range C overlaps the detection range K if the range C is detected as a non-image range by the density detectors 23. Consequently, the toner image G may be inadvertently detected as a toner image formed on the non-image range. To prevent such an erroneous detection, the non-image range must have a length long enough to include the detection range K.

Figure 10:
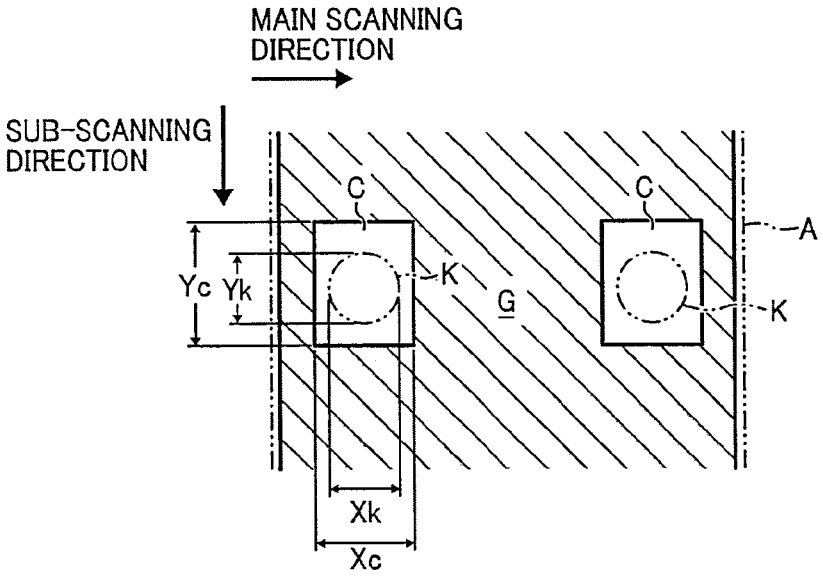
FIG. 10 is a view illustrating another example of a relation between size of a non-image range and size of a detection range.

In a case in which the range C onto which a toner image is not transferred is present corresponding to at least the detection range K during normal image formation even when the toner image G is transferred onto almost the whole range of the valid image range A as illustrated in FIG. 10, the range C can be determined as a non-image range. In such a case, the range C must have a length long enough to include the detection range K to be determined as a non-image range in order to prevent erroneous detection. Specifically, when a length Xc of the range C in the main scanning direction and the length Yc of the range C in the sub-scanning direction are equal to or longer than a length Xk of the detection range K in the main scanning direction and a length Yk of the detection range K in the sub-scanning direction, respectively, the range C is determined as a non-image range.

As described above, in the first illustrative embodiment, the range B positioned between the valid image ranges A is determined as a non-image range based on transmission of the frame gate signal. However, in the second illustrative embodiment, a non-image range within the valid image range A is not determined based only on transmission of the frame gate signal. Therefore, in the second illustrative embodiment, a status of the irradiating device 6 is detected to determine the non-image range such as the range C within the valid image range A. Determination of the non-image range according to the second illustrative embodiment is described in detail below using an example in which a blank, that is, the range C, is formed within the valid image range A in the main scanning direction as illustrated in FIG. 8.

A period of time required for the irradiating device 6 to write image data onto the surfaces of the photoconductors 2 in the main scanning direction while the photoconductors 2 are rotated for a single dot in the sub-scanning direction is hereinafter referred to as a time for a single line. A point within the valid image range on the surfaces of the photoconductors 2 when irradiation of the irradiating device 8 is stopped for the time for a single line is hereinafter referred to as T0. If irradiation is continuously stopped for a period of time Tth thereafter, a range on the surfaces of the photoconductors 2 passing thorough a position onto which the light is directed from the irradiating device 6 (hereinafter referred to as an irradiation point) during a period of time between T0 and T0+Tht becomes a non-electrostatic latent image range without an electrostatic latent image thereon. In addition, a period of time required for the non-electrostatic latent image range formed on the surfaces of the photoconductors 2 to contact the intermediate transfer belt 8 to be transferred onto the intermediate transfer belt 8 after being conveyed from the irradiation point and the non-electrostatic latent image transferred onto the intermediate transfer belt 8 to reach the density detectors 23 is hereinafter referred to as T1. Therefore, a period of time required for the non-electrostatic latent image to reach the density detectors 23 is obtained by adding the period of time T1 and the period of time between T0 and T0+Tht. Accordingly, a range of the intermediate transfer belt 8 that passes the density detectors 23 during a period of time between T0+T1 and T0+Tth+T1 is determined as a non-image range. It is to be noted that the period of time Tth during which irradiation of the irradiating device 6 is stopped is shorter than the period of time T1 required for the non-electrostatic latent image to move from the irradiation position to the density detectors 23. As a result, a non-image range is determined by detecting a timing when the irradiating device 6 stops irradiation in the second illustrative embodiment as described above.

A distance in which the intermediate transfer belt 8 moves within the period of time Tht when the irradiating device 6 stops irradiation is equal to the length Yc of the range C in the sub-scanning direction shown in FIG. 9A. Accordingly, the period of time Tth is multiplied by a rotation speed of the intermediate transfer belt 8 to calculate the length Yc of the range C in the sub-scanning direction. As a result, it is determined whether or not the range C includes the detection range K of the density detectors 23. The range C having a size for including the detection range K is selected to be detected in order to prevent erroneous detection of the density detectors 23.

A description is now given of a third illustrative embodiment of the present invention.

As described above, in the first illustrative embodiment, the reference toner density Dth set in advance is used as a reference value for determining whether or not toner is present in the non-image range. By contrast, in the third illustrative embodiment, the reflection light detection voltage Vsg on the surface of the intermediate transfer belt 8 detected by the density detectors 23 is used directly as the reference value. The reflection light detection voltage Vsg is compared to the detection voltage V in the non-image range to determine whether or not toner is present in the non-image range.

Specifically, before detecting the non-image range by the density detectors 23, the surface of the intermediate transfer belt 8 without toner is detected by the density detectors 23, and the reflection light detection voltage Vsg on the surface of the intermediate transfer belt 8 without toner at that time is stored as a reference voltage. It is to be noted that the detection of the reference voltage is performed during process control or initialization. Then, the non-image range is detected by the density detectors 23 to compare the detection voltage V in the non-image range at that time to the reference voltage, that is, the reflection light detection voltage Vsg (hereinafter also referred to as the reference voltage Vsg). The detection voltage V detected when toner is present in the non-image range is different from that when toner is not present. Accordingly, when the detection voltage V in the non-image range is considerably different from the reference voltage Vsg, it is determined that the toner is present in the non-image range. By contrast, when the detection voltage V in the non-image range is almost the same as the reference voltage Vsg, it is determined that the toner is not present in the non-image range. In practice, a predetermined value intermediate between a detection voltage when toner is present on the intermediate transfer belt 8 and that when toner is not present on the intermediate transfer belt 8 is set as the reference value. When the detection voltage V in the non-image range is smaller than the reference value, it is determined that toner is present in the non-image range. By contrast, when the detection voltage V in the non-image range is larger than the reference value, it is determined that toner is not present in the non-image range.

As described above, in the third illustrative embodiment, the detection voltage V and the reference voltage Vsg are compared to each other to determine whether or not toner is present in the non-image range. In other words, unlike the first illustrative embodiment, the detection voltage V does not need to be converted into the toner density in the third illustrative embodiment, thereby reducing processing load of the CPU or the like that converts the detection voltage V into the toner density.

It is preferable that the density detectors 23 be corrected, or calibrated, such that the reference voltage Vsg becomes constant. Although the reference voltage Vsg is obtained by detecting the surface of the intermediate transfer belt 8 without toner using the density detectors 23 as described above, toner may be attached to the surface of the intermediate transfer belt 8 when a malfunction such as irregular charging of the surfaces of the photoconductors 2 occur during detection of the reference voltage Vsg. In order to provide the surface of the intermediate transfer belt 8 without toner, it is preferable that the development control mode be employed in the third illustrative embodiment similarly to the first illustrative embodiment. Accordingly, toner is not attached to the surface of the intermediate transfer belt 8 even when a malfunction occurs, allowing the reference voltage Vsg to be reliably obtained.

As described above, according to the foregoing illustrative embodiments, occurrence of a malfunction can be detected by determining whether or not toner is present in the non-image range on the intermediate transfer belt 8. Accordingly, extremely precise determination criteria or detection accuracy is not required, thereby facilitating detection of a malfunction in the image forming apparatus 100.

In addition, detection of a malfunction is performed on the intermediate transfer belt 8 in the foregoing illustrative embodiments. Accordingly, provision of the density detector for each of the multiple photoconductors 2 is not required, achieving cost reduction. Further, the density detectors 23 used for adjusting an image density is also used as a malfunction detector in the foregoing illustrative embodiments, thereby achieving further cost reduction.

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the scope of the present invention, and all such modifications as would be obvious to one skilled in the art are intended to be included within the scope of the following claims.

The number of constituent elements and their locations, shapes, and so forth are not limited to any of the structure for performing the methodology illustrated in the drawings.

A configuration of the image forming apparatus 100 is not limited to that illustrated in FIG. 1 as long as the image forming apparatus 100 includes multiple photoconductors, an image forming unit that forms a toner image on each of the photoconductors, and a transfer body onto which the toner image formed on each of the photoconductors is transferred. Examples of the photoconductors include a drum-type photoconductor, a belt-type photoconductor, and so forth. Examples of the transfer body include a belt-type intermediate transfer belt, a drum-type transfer body, and so forth. Although the image forming apparatus 100 employs the negative-positive developing system, the foregoing illustrative embodiments are equally applicable to image forming apparatuses employing the positive-positive developing system.

What is claimed is:

1. An image forming apparatus, comprising:

at least one latent image carrier;

an image forming unit to form a toner image on the at least one latent image carrier based on image data;

a transfer body onto which the toner image formed on the at least one latent image carrier is transferred in one or more valid image ranges;

a non-image range determiner to determine a non-image range on a surface of the transfer body onto which the toner image is not transferred based on at least one time parameter related to the image data;

a surface detector to detect the surface of the transfer body in the non-image range; and a toner determiner to determine whether or not toner is present in the non-image range based on a result detected by the surface detector.

2. The image forming apparatus according to claim 1, wherein the non-image range is a range positioned between successive valid image ranges on the surface of the transfer body specified by transmission of a preset image range signal.

3. The image forming apparatus according to claim 1, wherein the non-image range includes a range corresponding at least to a detection range of the surface detector within the valid image range on the surface of the transfer body in which the toner image is not transferred based on the image data.

4. The image forming apparatus according to claim 3, wherein the non-image range is a range within the valid image range on the surface of the transfer body onto which the toner image is not transferred based on the image data, the non-image range having a size to include the detection range of the surface detector.

5. The image forming apparatus according to claim 1, wherein:

the surface detector is a density detector to detect a toner density on the surface of the transfer body; and the toner determiner compares a value detected in the non-image range by the surface detector to a reference value to determine whether or not toner is present in the non-image range.

6. The image forming apparatus according to claim 5, wherein the reference value is a fixed value set in advance.

7. The image forming apparatus according to claim 5, wherein the reference value is a toner density that the surface detector detects in a range on the surface of the transfer body onto which toner is not attached.

8. The image forming apparatus according to claim 7, further comprising multiple operation modes, wherein attachment of toner to the at least one latent image carrier is prevented in a development control mode, and the surface detector detects the range on the surface of the transfer body onto which toner is not attached obtained in the development control mode to set the reference value.

9. The image forming apparatus according to claim 8, wherein an electric field that electrostatically moves toner from the at least one latent image carrier to developing members included in the image forming unit is formed in the development control mode.

10. The image forming apparatus according to claim 1, wherein at least image data for an image range positioned immediately in front of the non-image range is stored upon determination of presence of toner in the non-image range by the toner determiner.

11. The image forming apparatus according to claim 1, wherein the non-image range includes a plurality of ranges along a main scanning direction within the valid image range on the surface of the transfer body in which the toner image is not transferred based on the image data.

12. The image forming apparatus according to claim 1, wherein the non-image range includes a plurality of ranges along a sub-scanning direction within the valid image range on the surface of the transfer body in which the toner image is not transferred based on the image data.

13. The image forming apparatus according to claim 1, wherein the transfer body is an intermediate transfer belt.

14. The image forming apparatus according to claim 1, wherein the result detected by the surface detector includes a toner density, and the toner determiner determines whether or not the toner is present in the non-image range based on a comparison of the toner density detected in the non-image range and a non-zero reference toner density for the non-image range.

15. The image forming apparatus according to claim 1, wherein the at least one time parameter corresponds to a time when a signal that specifies a valid image range for the latent image carrier that corresponds to a valid image range for the transfer body based on the image data is stopped.

16. The image forming apparatus according to claim 1, wherein the at least one time parameter corresponds to a time when the image forming unit does not direct light towards the latent image carrier while a signal that specifies a valid image range for the latent image carrier that corresponds to a valid image range for the transfer body based on the image data is transmitted.

17. An image forming apparatus, comprising:

at least one latent image carrier;

an image forming unit to form a toner image on the at least one latent image carrier based on image data;

a transfer body onto which the toner image formed on the at least one latent image carrier is transferred in one or more valid image ranges;

a non-image range determiner to determine a non-image range on a surface of the transfer body onto which the toner image is not transferred based on the image data;

a surface detector to detect the surface of the transfer body in the non-image range, wherein multiple detection ranges of the surface detector are provided on the transfer body in a direction perpendicular to a direction of rotation of the transfer body;

a toner determiner to determine whether or not toner is present in the non-image range based on a result detected by the surface detector; and a malfunction determiner to identify a type of malfunction based on the number of the detection ranges in which presence of toner is determined.

18. The image forming apparatus according to claim 17, wherein the malfunction determiner identifies occurrence of a malfunction including formation of a full-page solid image in which a solid image is formed in a whole range of the non-image range in the direction perpendicular to the direction of rotation of the transfer body by determination of presence of toner in all of the multiple detection ranges.

19. The image forming apparatus according to claim 17, wherein the malfunction determiner identifies occurrence of a malfunction other than formation of a full-page solid image by determination of presence of toner in a part of the multiple detection ranges.

20. The image forming apparatus according to claim 18, wherein image formation is stopped upon identification of occurrence of the malfunction.

21. The image forming apparatus according to claim 19, wherein whether to stop image formation is selectable upon identification of occurrence of the malfunction.

22. A method comprising the steps of:

forming a toner image on at least one latent image carrier based on image data;

transferring the toner image formed on the at least one latent image carrier onto a transfer body in one or more valid image ranges;

determining a non-image range on a surface of the transfer body onto which the toner image is not transferred based on at least one time parameter related to the image data;

detecting the surface of the transfer body in the non-image range; and determining whether or not toner is present in the non-image range based on a result detected in the detecting step.

* * * * *